United States Patent [19]

Thomann

[11] Patent Number: 4,649,672

[45] Date of Patent: Mar. 17, 1987

[54] INSTALLATION FOR CLEANING BUILDING

[76] Inventor: Chantal Thomann, 7 Chemin de l'Escalette, Uzes (Gard), France

[21] Appl. No.: 704,261

[22] Filed: Feb. 22, 1985

[30] Foreign Application Priority Data

Feb. 29, 1984 [FR] France ..... 84 03171

[51] Int. Cl.[4] ..... B24C 9/00

[52] U.S. Cl. ..... 51/424; 51/426

[58] Field of Search ..... 51/424, 425, 429, 262, 51/273, 426, 427; 55/442, 233, 259

[56] References Cited

U.S. PATENT DOCUMENTS 3,407,538 10/1968 Codina et al. ..... 51/410
3,522,000 7/1970 Kinney ..... 55/233
4,020,596 5/1977 Bergh ..... 51/429

FOREIGN PATENT DOCUMENTS 0034496 3/1977 Japan ..... 51/410
8001014 2/1981 World Int. Prop. O. ..... 51/429
2099329 12/1982 United Kingdom ..... 55/233

*Primary Examiner*—Frederick R. Schmidt
*Assistant Examiner*—Bradley I. Vaught
*Attorney, Agent, or Firm*—Kinzer, Plyer, Dorn & McEachran

[57] ABSTRACT

(a) An installation for cleaning buildings by the blasting of solid particles; (b) characterised in that it comprises a cabin (1) having: an open front surface (2), an intermediate wall (4) having fans (5); a floor (3); a lateral surface (7) at the rear formed with air discharge apertures ($7_1$); a filter panel (6) disposed between the intermediate wall (4) and the rear wall; a substantially funnel-shaped bottom surface (10) having a discharge duct (11) for the solid particles collected by the filter panel (6); and a housing (13) extending around the open front surface (2) and projecting therebeyond outside the cabin and made of a flexible material ($13_1$) disposed on a framework ($13_2$) of inflatable tubes ($13_3$, $13_4$).

4 Claims, 2 Drawing Figures

INSTALLATION FOR CLEANING BUILDING

The invention relates to an installation for cleaning buildings.

According to the invention, the installation comprises a cabin having: an open front surface engageable with the facade of the building to be cleaned; an intermediate wall parallel to the cabin front surface and having fans intaking air from the region near the last-mentioned surface; a floor on which the operatives can stand and which is disposed between the last-mentioned surface and the intermediate wall; a lateral surface at the rear formed with air discharge apertures; a filter panel disposed parallel to and between the intermediate wall and the rear wall; a substantially funnel-shaped bottom surface having a discharge duct for the solid particles collected by the filter panel; and a housing extending around the open front surface and projecting therebeyond outside the cabin and made of a flexible material disposed on a framework of inflatable tubes.

According to another feature of the invention, the apertures in the rear surface are associated with panels inclined upwardly and outwardly relative to the cabin.

According to another feature of the invention, the cabin is mounted on the end of the lifting arm of a lift, the cabin being connected to the arm by way of a mounting enabling the cabin to rotate around a vertical axis X—X parallel to the cabin front surface and by way of a mounting enabling the cabin to pivot around a horizontal shaft perpendicular to the axis X—X and to the lifting arm axis.

The invention is illustrated by way of non-limitative example in the accompanying drawings wherein.

Figure 2:
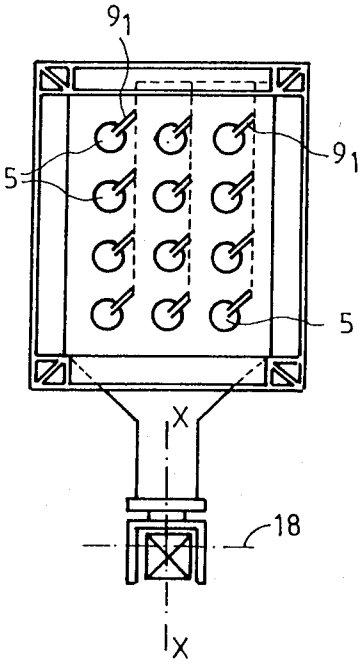
FIG. 2 is a view looking from the right in FIG. 1.
Figure 1:
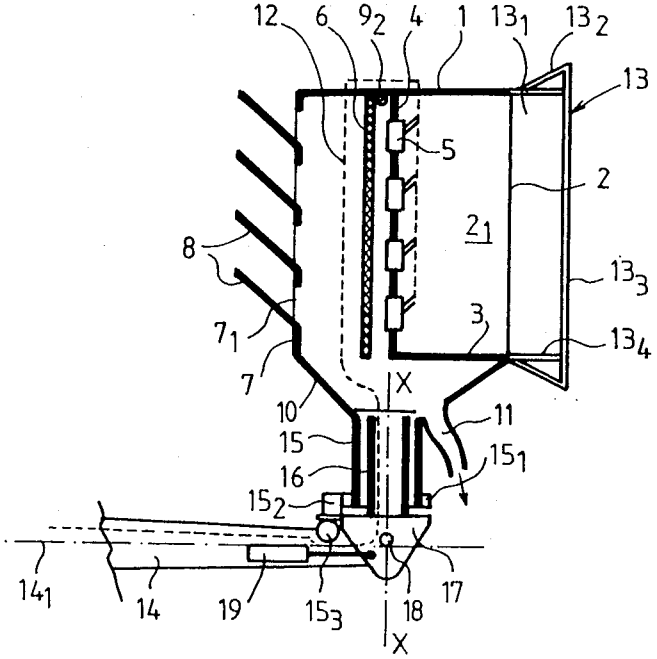
FIG. 1 is a diagrammatic view in vertical section of the installation.

The installation shown in the drawings mainly comprises a cabin 1 made, for example, of sheet aluminium and having an open side surface 2 at the front. The surface 2 is adapted to be disposed opposite the wall of the building to be cleaned so that operatives standing on the floor 3 can, using a nozzle, air blast the building with solid particles.

The particles are dry silica powder of a grain size of from 1 to 70 microns, suitable for cleaning the building rapidly and effectively but without damage to the building facade.

Inside the cabin 1 there is an intermediate vertical wall 4 which extends parallel to the front surface 2 and which is separated therefrom by the floor 3. The wall 4 has a bank of fans 5 serving to intake from front zone $2_1$ air conditioning silica powder particles in suspension, the fans discharging such air to a filter panel 6 disposed parallel to and behind the wall 4.

A lateral surface 7 of the cabin at the rear is formed with apertures $7_1$. Panels 8 are secured to the bottom edge of the apertures $7_1$ and are inclined outwardly and upwardly of the cabin in order to act as deflectors ensuring that the air intaken by the fans 5 and passing through the panels 6 is not discharged horizontally outside the cabin.

A water spray tube $9_1$ extends in front of each fan 5 and a water spray ramp $9_2$ is disposed on the top edge of the front surface of the panel 6.

The effect of spraying the fan blades with water through the tubes $9_1$ is to humidify the air and the solid particles therein so that the particles are deposited on the front surface of the filter panel 6. The water discharging from the ramp $9_2$ on to the panel 6 continually washes the front surface thereof, the mixture of water and particles being collected in a funnel 7 forming the bottom surface of the cabin, the mixture being discharged through a duct 11.

The tube $9_1$ and the ramp $9_2$ are supplied with pressurized water through a flexible line 12.

Extending around the cabin front surface 2 is a housing 13 made of a flexible material $13_1$, such as a tarpaulin, disposed on a framework $13_2$ of pneumatic tubes.

The housing 13 comprises a front peripheral tube $13_3$ and tubes $13_4$ which connect the tube $13_3$ to the periphery of the front surface 2.

The cabin 1 is mounted at the end of the lifting arm 14 of a lift. The connection between the cabin 1 and the arm 14 comprises two concentric tubes 15, 16, the tube 15 being secured to the base of the funnel 10 while the tube 16 is secured to a pivoted clevis 17 by way of a shaft 18 on the arm 14. The outer tube 15 has at the bottom a gear wheel $15_1$ meshing with a worm $15_2$ driven by a hydraulic motor $15_3$. The concentric tubes 15, 16 therefore provide a mounting of the cabin 1 such that the same can rotate around a vertical axis X—X parallel to the cabin front surface 2. The pivot shaft 18 is perpendicular to the axis X—X and to the lifting-arm axis $14_1$.

The clevis 17 can be pivoted by a hydraulic ram 19 to modify the tilt of the cabin and so that the same can be disposed in horizontal extension of the arm 14 for when the lift moves. Rotation of the tubes 15 and 16 relatively to one another by means of the motor $15_3$ alters cabin orientation so that the cabin front surface 2 can be placed opposite the building to be cleaned without the need to alter the position of the lift.

I claim:

1. An installation for cleaning buildings by blasting solid particles through nozzles, characterized in that it comprises a cabin (1) having: an open front surface (2) engageable with the facade of the building to be cleaned; said cabin having an intermediate wall (4) parallel to the cabin front surface (2) and having mounted thereon fans (5) intaking air and suspended particles used for blasting from the front region ($2_1$) within the cabin near the last-mentioned surface (2); said cabin having a floor (3) on which the operatives can stand and which is disposed between the lastmentioned surface (2) and the intermediate wall (4); said cabin having a rear wall and a lateral surface (7) at the rear wall formed with air discharge apertures ($7_1$); said cabin having a filter panel (6) disposed parallel to and between the intermediate wall (4) and the rear wall so as to be disposed behind the fans for removing suspended particles in suspension; water spray tubes ($9_1$) positioned in front of the fans to humidify the suspended particles which reach the front of the filter and a water spray ramp ($9_2$) behind the fans for washing the front of the filter, said cabin having a substantially funnel-shaped bottom surface (10) disposed beneath the floor (3) and in communication with the back and front of the filter panel, said bottom surface having a discharge duct (11) for the solid particles collected by and washed from the filter panel (6); and a housing (13) extending around the open front surface (2) and projecting therebeyond outside the cabin and made of a flexible material ($13_1$) disposed on a framework ($13_2$) of inflatable tubes ($13_3$, $13_4$).

2. An installation according to claim 1, characterised in that the apertures in the rear wall (7) are associated with panels (8) inclined upwardly and outwardly relatively to the cabin so that air intaken by the fans is not discharged horizontally from the cabin through said apertures.

3. An installation according to claim 1, characterised in that the cabin (1) is mounted on the end of the lifting arm (14) of a lift, the cabin being connected to the arm (14) by way of a mounting enabling the cabin to rotate around a vertical axis X—X parallel to the cabin front surface (2) and by way of a mounting enabling the cabin to pivot around a horizontal shaft (18) perpendicular to the axis X—X and to the lifting arm axis ($14_1$).

4. An installation according to claim 3, characterised in that the rotatable mounting system comprises two concentric tubes (15, 16) rotatable relatively to one another, one tube (15) being secured to the cabin and the other tube (16) being secured to the lifting arm (14) by a clevis (17) in which the horizontal pivot shaft (18) is disposed.

* * * * *